33-233 SR
4/26/88 OR 4,739,559

United States Patent [19]
Hohensee et al.

[11] Patent Number: 4,739,559
[45] Date of Patent: Apr. 26, 1988

[54] ARRANGEMENT FOR HOLDING AN AIMING DEVICE ON A GUN BARREL

[75] Inventors: Heinz Hohensee, Kiel; Walter Jakob, Heikendorf; Peter Müller, Kiel, all of Fed. Rep. of Germany

[73] Assignee: Krupp Mak Maschinenbau GmbH, Kiel, Fed. Rep. of Germany

[21] Appl. No.: 18,195

[22] Filed: Feb. 24, 1987

[30] Foreign Application Priority Data

Mar. 5, 1986 [DE] Fed. Rep. of Germany ... 8605954[U]

[51] Int. Cl.[4] ..... F41G 3/00
[52] U.S. Cl. ..... 33/233; 33/250
[58] Field of Search ..... 33/252, 245, 233, 250, 33/261; 42/100-103

[56] References Cited

U.S. PATENT DOCUMENTS 2,645,017 7/1953 Haase ..... 42/100 X

FOREIGN PATENT DOCUMENTS 672561 10/1963 Canada ..... 42/100

*Primary Examiner*—Harry N. Haroian
*Attorney, Agent, or Firm*—Erwin S. Teltscher

[57] ABSTRACT

An arrangement for releasably holding an aiming device on a gun barrel, which includes a sleeve-shaped holder arranged to be placed on the gun barrel and to thereby hold the aiming device on said the barrel; and a pressure fluid supply device arranged to supply a pressure fluid to the holder so that the holder expands and moves on the gun barrel, and also to thereafter remove the pressure fluid from the holder, so that the holder subsequently shrinks and becomes fixed on the gun barrel.

8 Claims, 1 Drawing Sheet

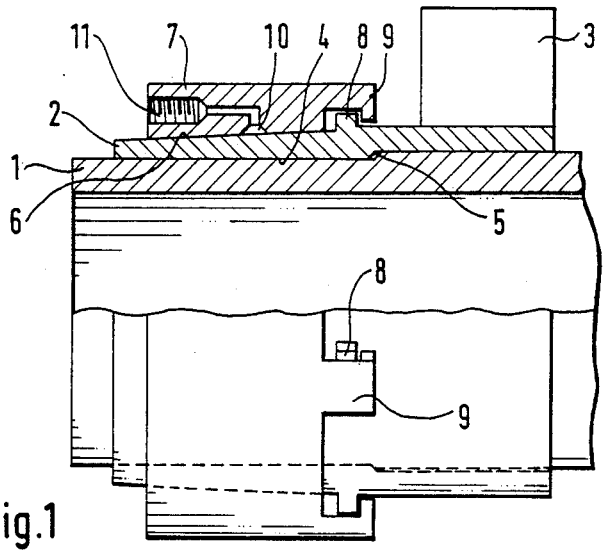
Fig.1
Fig.2
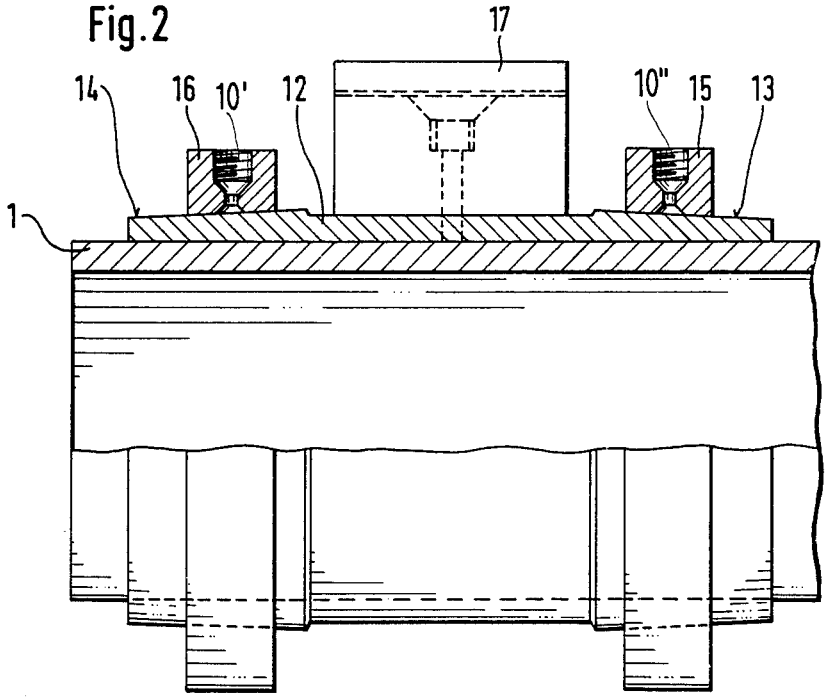

ARRANGEMENT FOR HOLDING AN AIMING DEVICE ON A GUN BARREL

BACKGROUND OF THE INVENTION

The present invention relates to an arrangement for releasably holding the aiming means on gun barrels.

It is known to provide holders of such devices on muzzles of gun barrels, for example to provide a sighting adjustment of a weapon relative to a launching rack. The aiming means remain on the gun barrel during shooting; however, they must be dismountable for corresponding repairs on the gun barrels.

The requirement of the shooting sturdiness in connection with the requirement of the releasability of the holders pose some problems especially in high-power gun barrels, such as main guns of battle tanks. It has been recognized that conventional holders which are screwed or clamped on by bandages are not sufficiently strong and change their position during shooting. Especially unsatisfactory are the holders with masses which are non-uniformly distributed over the barrel periphery.

SUMMARY OF THE INVENTION

Accordingly, it is an object of the present invention to provide a holder of the above-mentioned general type, which avoids the disadvantages of the prior art.

More particularly, it is an object of the present invention to provide a simple operating holder of the above type, which ensures both a substantially uniform distribution of the masses over the periphery of the gun barrel, as well as a firm contact under high loadings.

In keeping with these objects and with others which will become apparent hereinafter, one feature of the present invention resides, briefly stated, in that the aiming means are arranged on a gun on a barrel through a sleeve-shaped holder so that they are displaceable on the gun barrel through the supply of a fluid, such as oil, under pressure, with a resulting elastic expansion, and that they are securable to the gun barrel by subsequently withdrawing the pressure fluid with a resulting shrinkage.

When the holder for the aiming means on a gun barrel is formed in accordance with the present invention, it avoids the disadvantages of the prior art and ensures the above-mentioned advantages.

In accordance with an especially advantageous embodiment of the present invention, the sleeve-shaped holder is formed as a thin sleeve which has a profiled outer surface for a fluid, e.g. an oil connection, and at least one pressure ring with a corresponding profiled inner surface arranged on the outer surface of the thin sleeve, so that the sleeve-shaped holder expands under the action of the oil under pressure. After placement of the pressure ring on the sleeve, the sleeve is so strongly compressed that it provides a fixed contact with the gun barrel and withstands high loading.

In accordance with another embodiment of the invention which is especially recommended for extremely high loading, the sleeve-shaped holder and the pressure ring can be clamped to one another through rotation of corresponding elements.

In a further embodiment of the present invention, it is proposed that the sleeve-shaped holder can be fixed on the gun barrel by means of two pressure rings.

It is known that thin-walled gun barrels have a tendency to concentric radial vibrations with a very high amplitude during shooting. This can lead to a temporary lifting of the holder from the barrel, when the barrel shrinks from its maximum diameter to a smaller diameter. This is especially the case when the radial resonance frequency of the holder is smaller than that of the barrel. For avoiding this, it is proposed, in accordance with the present invention, to mount the sleeve-shaped holder on the gun barrel by means of a pressure ring which has a material or a material composition with a greater ratio of the modulus of elasticity/specific density than the material of the gun barrel itself.

In an advantageous embodiment of the present invention the pressure ring has a slightly conically tapered inner surface and is fitted over a respective receiving region of the sleeve-shaped holder which is, in turn, provided with a corresponding slightly conically tapered outer surface.

The novel features of the present invention are set forth in particular in the appended claims. The invention itself, however, both as to its construction and its method of operation, will be best understood from the following description of a preferred embodiment which is accompanied by the following drawings.

BRIEF DESCRIPTION OF THE DRAWINGS

FIG. 1 is a view showing a section of an arrangement for releasably holding aiming means on a gun barrel, in accordance with the present invention; and FIG. 2 is a view which substantially corresponds to the view of FIG.1, but shows the arrangement in accordance with another embodiment of the invention.

DESCRIPTION OF PREFERRED EMBODIMENTS

An muzzle of a gun barrel is identified with the reference numeral 1. A sleeve-shaped holder 2 is arranged on the muzzle 1 of the gun barrel. The holder 2 holds a housing 3 for aiming means on its one end. The holder 2 has an inner surface with a diameter which corresponds to the diameter of an outer surface of the muzzle 1 of the gun barrel. The same is true with respect to a portion of the holder 2, which cooperates with a stop 5 provided on the outer surface of the gun barrel.

The holder 2 has in its front region a conical outer surface 6 which corresponds to a conical inner surface of a pressure ring 7 fitted onto the holder 2. The holder 2 is additionally provided with arresting projections 8 which cooperate with respective clamping parts 9 of the pressure ring 7. The pressure ring 7, which is mountable on the holder 2, is also provided with an oil distributing groove 10; the latter can be supplied with a hydraulic fluid under pressure through a connecting opening 11.

For clamping, the holder 2 is first placed on the muzzle 1 of the gun barrel and brought to a desired position. Thereafter the pressure ring 7 is placed on the holder until it is firmly seated on the conical surface 6. Care should be taken that the clamping parts 9 are located in the gaps between the arresting projections 8. The hydraulic fluid under pressure is supplied into the oil distributing groove or passage 10 through the opening 11, and as a result of this pressurized fluid supply the pressure ring 7 expands and is displaced on the holder 2 in a step-wise manner in correspondence with its expansion with the aid of a non-illustrated device, until it reaches the indicated end position. In this end position the ring, which has been hydraulically expanded, is rotated so that the arresting projections 8 and the clamping parts 9 engage each other. The pressure ring 7 is then hydraulically unloaded, namely the hydraulic fluid is withdrawn from the distributing passage 10, the pressure ring 7 shrinks and firmly presses the holder 2 onto the muzzle 1 of the gun barrel.

In the arrangement in accordance with the embodiment of FIG. 2 a sleeve-shaped holder 12 is provided with two conical surfaces 13 and 14. Pressure rings 15 and 16 are pressed onto the conical surfaces 13 and 14 in the manner described for the embodiment of FIG. 1. The pressure ring 15 is provided with a passage 10'', and the pressure ring 16 is provided with a passage 10' corresponding to the passage 10 in the embodiment of FIG. 1. A housing 17 for the aiming means is screwed onto the holder 12. This holder 12 has the advantage that the muzzle 1 of the gun barrel is clamped in two peripheral planes by the holder 12, and wherein the peripheral planes are spaced from one another. Thereby it is possible even in the event of high shooting loading and the resulting concentric radial resonant vibrations, to obtain a certain equilibrium between the different vibration phases. As a result of this, the holder 12 maintains at any given time a firm contact with the muzzle 1 of the gun barrel, at least in the region of one of the pressure rings 15 and 16.

The invention is not limited to the details shown since various modifications and structural changes are possible without departing in any way from the spirit of the present invention.

What is desired to be protected by Letters Patent is set forth in the appended claims.

We claim:

1. An arrangement for releasably holding aiming means on a gun barrel, comprising in combination a sleeve-shaped holder arranged to be placed on said gun barrel and to thereby hold said aiming means on said gun barrel;

pressure fluid supply means arranged to supply a pressure fluid to said holder so that said holder expands and moves on the gun barrel, means for thereafter removing the pressure fluid from said holder, and wherein said sleeve-shaped holder includes a sleeve arranged to be placed on the gun barrel, and at least one pressure ring placed on said sleeve, a passage for said pressure fluid supply means being formed between said sleeve and said pressure ring, so that said pressure ring expands and shrinks upon the supply to, and removal of the pressure fluid from said pressure fluid passage, respectively, while said sleeve, upon removal of said pressure fluid from said pressure fluid passage, also shrinks and become fixed on the gun barrel.

2. An arrangement as defined in claim 1, wherein said sleeve of said holder has a profiled outer surface, said pressure ring of said holder having a profiled inner surface which embraces said profiled outer surface of said sleeve.

3. An arrangement as defined in claim 1, and further comprising clamping means for clamping said sleeve and said pressure ring of said holder to one another.

4. An arrangement as defined in claim 3, wherein said clamping means include clamping elements formed on said sleeve and on said pressure ring so that said sleeve and said pressure ring are clamped to one another upon being rotated relative to one another into a clamped position with the aid of said clamping elements.

5. An arrangement as defined in claim 1 wherein said holder includes a sleeve arranged to be placed on the gun barrel, and two pressure rings placed on said sleeve at two respective locations which are spaced from one another, a respective passage for said pressure fluid supply means being formed between said sleeve and a respective of said pressure rings, so that the corresponding pressure ring expands and shrinks upon the supply to, and removal of the pressure fluid from the respective pressure fluid passage, respectively.

6. An arrangement as defined in claim 1, wherein the gun barrel has a predetermined ratio of modulus of elasticity/specific density, said pressure ring being composed of a material which has a higher ratio of said modulus of elasticity/specific density than that of said gun barrel.

7. An arrangement as defined in claim 1, wherein the gun barrel has a predetermined ratio of modulus of elasticity/specific density, said pressure ring being composed of a material composition which has a higher ratio of said modulus of elasticity/specific density than that of said gun barrel.

8. An arrangement as defined in claim 1, wherein said sleeve of said holder has a receiving region with a substantially conical outer surface, said pressure ring having a substantially conical inner surface arranged on said substantially conical outer surface of said region of said sleeve.

* * * * *